United States Patent [19]

Sudweeks et al.

[11] 4,322,258

[45] Mar. 30, 1982

[54] THERMALLY STABLE EMULSION EXPLOSIVE COMPOSITION

[75] Inventors: Walter B. Sudweeks, Orem; Larry D. Lawrence, Salt Lake City, both of Utah

[73] Assignee: IRECO Chemicals, Salt Lake City, Utah

[21] Appl. No.: 92,897

[22] Filed: Nov. 9, 1979

[51] Int. Cl.[3] ..... C06B 45/00

[52] U.S. Cl. ..... 149/2; 149/60; 149/61

[58] Field of Search ..... 149/2, 28, 60, 61

[56] References Cited

U.S. PATENT DOCUMENTS

| | | | |
|---|---|---|---|
| 3,765,964 | 10/1973 | Wade | 149/2 |
| 4,032,375 | 6/1977 | Wasson | 149/2 F |
| 4,104,092 | 8/1978 | Mullay | 149/2 |
| 4,110,134 | 8/1978 | Wade | 149/2 |
| 4,111,727 | 9/1978 | Clay | 149/2 |
| 4,141,767 | 2/1979 | Sudweeks et al. | 149/2 |

*Primary Examiner*—Edward A. Miller

*Attorney, Agent, or Firm*—Robert A. Bingham

[57] ABSTRACT

The invention relates to a thermally stable, cap-sensitive water-in-oil emulsion explosive composition having a discontinuous aqueous oxidizer salt solution phase containing calcium nitrate, a continuous oil or water-immiscible liquid organic phase, an emulsifier, and a density reducing agent.

9 Claims, No Drawings

THERMALLY STABLE EMULSION EXPLOSIVE COMPOSITION

The present invention relates to improved explosive compositions. More particularly, the invention relates to thermally stable, cap-sensitive water-in-oil emulsion explosive compositions having a discontinuous aqueous oxidizer salt solution phase containing calcium nitrate and a continuous oil or water-immiscible liquid organic phase. The compositions comprise (a) discrete droplets of an aqueous solution of inorganic oxidizer salt(s), of which at least about 20% by weight based on the total composition is calcium nitrate, (b) a water-immiscible liquid organic fuel forming a continuous phase throughout which the droplets are dispersed, (c) an emulsifier that forms an emulsion of the oxidizer salt solution droplets throughout the continuous liquid organic phase, and (d) a density reducing agent. As used herein, the term "thermally stable" means that the composition retains its cap-sensitivity when stored for more than several weeks at temperatures as high as 50° C. As used herein, the term "cap-sensitive" means that the composition is detonable with a No. 8 cap at 20° C. in a charge diameter of 32 mm or less.

Aqueous slurry explosives generally have a continuous aqueous phase throughout which immiscible liquid hydrocarbon fuel droplets or solid ingredients may be dispersed. In contradistinction, the compositions of the present invention have a continuous oil phase throughout which discrete droplets of aqueous solution are dispersed.

Water-in-oil emulsion blasting agents and explosives are known in the art. See, for example, U.S. Pat. Nos. 4,141,767; 4,110,134; 4,008,108; 3,447,978; Re: 28,060; 3,765,964; 3,770,552; 3,715,247; 3,212,945; 3,161,551; 3,376,176; 3,296,044; 3,164,503; and 3,232,019. Several of these patents disclose cap-sensitive water-in-oil emulsion explosives. Emulsion explosives have certain distinct advantages over conventional explosives as explained in U.S. Pat. No. 4,141,767.

A major problem with cap-sensitive emulsion explosive compositions in the past is that although generally they retain their cap-sensitivity at relatively low temperatures, e.g. −20° C., they tend to lose their cap-sensitivity when stored at relatively high temperatures, e.g. 30° C.–50° C. Commercial packaged explosives must be sufficiently stable to withstand storage of up to several months or more in order to meet the requirements of users in the field. Further, since storage temperatures vary in the field, depending upon such factors as place of storage, season and climate, it is important that a packaged explosive retain its sensitivity over the full range of potential storage temperatures. Moreover, certain blasting locations have basically warm weather climates and thus require thermally stable explosives. Heretofore, packaged cap-sensitive emulsion explosives have not been successfully stored under conditions of high temperatures. The present invention solves this prior problem by providing a thermally stable, cap-sensitive water-in-oil emulsion explosive that can be used and stored successfully in warm temperatures.

SUMMARY OF THE INVENTION

The composition of the invention comprises a thermally stable, cap-sensitive water-in-oil emulsion explosive composition having a water-immiscible liquid organic fuel as a continuous phase; an emulsified aqueous inorganic oxidizer salt solution as a discontinuous phase, which salt solution contains calcium nitrate in an amount of at least about 20% by weight based on the total composition; an emulsifier; and a density reducing agent.

DETAILED DESCRIPTION OF THE INVENTION

The basis of the present invention is the use of calcium nitrate (CN) in an amount of at least about 20% by weight based on the total composition. The percentage of CN will hereafter be taken to include water of crystallization which normally is associated with the CN in amounts of about 15% by weight for fertilizer grade CN. However, anhydrous CN can be substituted in which event the minimum amount required would be reduced by about 15% ($20\% \times 0.85 = 17\%$). Preferably, the amount of CN added is less than 50% of the total oxidizer salt content of the explosive composition. Additional oxidizer salt or salts are selected from the group consisting of ammonium, alkali and alkaline earth metal nitrates, chlorates and perchlorates. The amount of total oxidizer salt employed is generally from about 45% to about 90% by weight of the total composition, and preferably from about 60% to about 86%. Preferably, the major oxidizer salt is ammonium nitrate (AN) in an amount of from about 20% to about 60% by weight. It is preferred that the ratio of AN to CN exceed 1.0. In addition, minor amounts of sodium nitrate (SN) or other salts can be added.

It is not fully understood how the CN functions to render the compositions thermally stable. Preferably all of the oxidizer salt is dissolved in the aqueous salt solution during formulation of the composition. However, after formulation and cooling to ambient temperature, some of the oxidizer salt may precipitate from the solution. Because the solution is present in the composition as small, discrete, dispersed droplets, the crystal size of any precipitated salt normally will be physically inhibited. This is advantageous because it allows for greater oxidizer-fuel intimacy. At higher ambient temperatures and in emulsion compositions containing only AN or AN and SN, the crystal growth may expand beyond the droplet boundaries or be of such form as to desensitize the composition. With the presence of a significant amount of CN, however, the crystal growth appears to be modified or inhibited to a degree such that desensitization does not occur. An explanation may be found in the facts that CN is strongly hydrated, its presence reduces the crystallization temperature of the salt solution, and it forms double salts with AN. Whatever the reason, the presence of the CN does prevent thermal desensitization.

Water in addition to that contained as CN water of crystallization is employed in an amount of from about 2% to about 15% by weight, based on the total composition. It is preferably employed in amounts of from about 5% to about 10%. Percentages of water herein will be taken to exclude the CN water of crystallization. Water-miscible organic liquids can partially replace water as a solvent for the salts, and such liquids also function as a fuel for the composition. Moreover, certain organic liquids act as freezing point depressants and reduce the fudge point of the oxidizer salts in solution. This can enhance sensitivity and pliability at low temperatures. Miscible liquid fuels can include alcohols such as methyl alcohol, glycols such as ethylene glycols, amides such as formamide, and analogous nitrogen-containing liquids. As is well known in the art, the amount of total liquid used will vary according to the fudge point of the salt solution and the desired physical properties.

The immiscible liquid organic fuel forming the continuous phase of the composition is present in an amount of from about 1% to about 10%, and preferably in an amount of from about 3% to about 7%. The actual amount used can be varied depending upon the particular immiscible fuel(s) and supplemental fuel(s) (if any) used. When fuel oil or mineral oil are used as the sole fuel, they are preferably used in amount of from about 4% to about 6% by weight. The immiscible organic fuels can be aliphatic, alicyclic, and/or aromatic and can be saturated and/or unsaturated, so long as they are liquid at the formulation temperature. Preferred fuels include mineral oil, waxes, paraffin oils, benzene, toluene, xylenes, and mixtures of liquid hydrocarbons generally referred to as pertroleum distillates such as gasoline, kerosene and diesel fuels. Particularly preferred liquid fuels are mineral oil, No. 2 fuel oil, paraffin waxes, and mixtures thereof. Tall oil, fatty acids and derivatives, and aliphatic and aromatic nitrocompounds also can be used. Mixtures of any of the above fuels can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed above. These additional solid and/or liquid fuels can be added generally in amount ranging up to 15% by weight. If desired, undissolved oxidizer salt can be added to the composition along with any solid or liquid fuels.

The emulsifier of the present invention can be selected from those conventionally employed, and various types are listed in the above-referenced patents. The emulsifier is employed in an amount of from about 0.2% to about 5% by weight. It preferably is employed in an amount of from about 1% to about 3%. Typical nonionic and cationic emulsifiers include sorbitan fatty acid esters, glycol esters, unsaturated substituted oxazolines, derivatives thereof and the like. Preferably the emulsifier is in its unsaturated form.

The compositions of the present invention are reduced from their natural densities of near 1.5 g/cc, primarily by addition of a density reducing agent in an amount sufficient to reduce the density to within the range of from about 0.9 to about 1.4 g/cc. Density reduction is essential for cap-sensitivity. For example, gas bubbles can be entrained into the composition during mechanical mixing of the various ingredients or can be introduced by a chemical means such as a small amount (0.01% to about 0.2% or more) of a gassing agent such as sodium nitrite, which decomposes chemically in the composition to produce gas bubbles. Small hollow particles such as plastic or glass spheres and perlite can be added. It has been found that perlite having an average particle size ranging from about 100 microns to about 150 microns will impart cap-sensitivity to an emulsion explosive. Two or more of the above-described density reducing agents may be added simultaneously.

One of the main advantages of a water-in-oil explosive over a continuous aqueous phase slurry is that thickening and cross-linking agents are not necessary for stability and water resistancy. However, such agents can be added if desired. The aqueous solution of the composition can be rendered viscous by the addition of one or more thickening agents of the type and in the amount commonly employed in the art.

The compositions of the present invention are formulated by preferably first dissolving the oxidizer salt(s) in the water (or aqueous solution of water and miscible liquid fuel) at an elevated temperature of from about 25° C. to about 90° C., depending upon the fudge point of the salt solution. The emulsifier and the immiscible liquid organic fuel then are added to the aqueous solution, preferably at the same elevated temperature as the salt solution, and the resulting mixture is stirred with sufficient vigor to invert the phases and produce an emulsion of the aqueous solution in a continuous liquid hydrocarbon fuel phase. Usually this can be accomplished essentially instantaneously with rapid stirring. (The compositions also can be prepared by adding the aqueous solution to the liquid organic.) Stirring should be continued until the formulation is uniform. Solid ingredients if any are then added and stirred throughout the formulation.

It has been found to be particularly advantageous to predissolve the emulsifier in the liquid organic fuel prior to adding the organic fuel to the aqueous solution. Preferably, the fuel and predissolved emulsifier are added to the aqueous solution at about the temperature of the solution. This method allows the emulsion to form quickly and with little agitation.

Sensitivity and stability of the compositions may be improved by passing them through a high-shear system to break the dispersed phase into even smaller droplets prior to adding the density control agent. This additional processing through a colloid mill has shown an improvement in rheology and performance.

In further illustration of the invention, Table I contains formulations and detonation results of preferred compositions (B-H) of the present invention. Compositions C-H were tested for high temperature (50° C.) stability and were found to retain their cap-sensitivity even when stored at 50° C. for as long as 2 months. In contrast, Composition A, which contained only 13.80% CN, and Compositions I-M, which contained SN instead of CN, all became non-cap-sensitive upon storage at the elevated temperatures indicated (50° C. and 40° C.). Thus, the data clearly show that the presence of relatively high amounts of CN (20% or more) imparts thermal stability to emulsion explosive compositions.

The compositions of the present invention can be used in the conventional manner. For example, they can be packaged, such as in cylindrical sausage form. Depending upon the ratio of aqueous and oil phases, the compositions are extrudable and/or pumpable with conventional equipment. The low temperature, small diameter sensitivity and the inherent water-proofness of the compositions render them versatile and economically advantageous for most applications.

While the present invention has been described with reference to certain illustrative examples and preferred embodiments, various modifications will be apparent to those skilled in the art and any such modifications are intended to be within the scope of the invention as set forth in the appended claims.

TABLE I

| COMPOSITION INGREDIENTS (Parts by Weight) | A | B | C | D | E | F | G | H | I | J | K | L | M |
|---|---|---|---|---|---|---|---|---|---|---|---|---|---|
| AN | 69.00 | 55.85 | 53.75 | 57.61 | 48.85 | 48.33 | 48.33 | 48.33 | 67.49 | 67.49 | 63.91 | 66.79 | 65.96 |
| CN[a] | 13.80 | 27.93 | 26.88 | 20.09 | 32.09 | 32.64 | 32.64 | 32.64 | — | — | — | — | — |
| SN | — | — | — | — | — | — | — | — | 13.49 | 13.49 | 12.77 | 13.35 | 13.18 |
| $H_2O$ | 9.55 | 7.63 | 7.34 | 11.02 | 2.87 | 5.30 | 5.30 | 11.42 | 11.42 | 10.81 | 11.30 | 11.16 | |
| Emulsifier[b] | 1.06 | 1.07 | 1.37 | 1.40 | 1.99 | 1.38 | 1.38 | 1.38 | 1.05 | 1.05 | 0.99 | 2.07 | 1.02 |
| Liquid Organic | 4.46[c] | 5.37[c] | 3.92[c] | 3.42[c] | 5.28[c] | 3.97[c] | 3.97[d] | 3.97[d] | 4.66[c] | 4.66[c] | 4.42[c] | 4.62[c] | 6.83[c] |
| Density Reduction Agent[e] | 2.12 | 2.15 | 1.92 | 2.00 | 3.92 | 2.96 | 2.96 | 2.96 | 1.89 | 1.89 | 1.79 | 1.87 | 1.85 |
| Other Fuel[f] | — | — | 4.81 | 4.51 | — | 5.42 | 5.42 | 5.42 | — | — | 5.30 | — | — |
| Density (g/cc) | 1.21 | 1.21 | 1.24 | 1.19 | 1.03 | 1.17 | 1.10 | 1.10 | 1.20 | 1.21 | 1.24 | 1.21 | 1.20 |
| Detonation Results[g] | | | | | | | | | | | | | |
| 5° C. 28mm | #4/#3 | #8/#6 | #8/#6 | #8/#6 | — | — | — | — | — | — | — | — | — |
| 50 mm | 5.1 | 4.7 | — | — | — | — | — | — | — | — | — | — | — |
| 38mm | 4.9 | 4.7 | 4.2 | 4.4 | — | — | — | — | — | — | — | — | — |
| 32mm | — | — | — | — | #4/#3 | #4/#3 | #6/#5 | #5/#4 | #5/#4 | #4/#3 | #4/#3 | #5/#4 | #5/#4 |
| 5° C. after 1 Week | — | — | — | — | — | — | — | — | #5/#4 | #5/#4 | #5/#4 | #5/#4 | #6/#5 |
| magazine 2 Weeks | — | — | — | — | — | — | — | — | #5/#4 | #6/#5 | #5/#4 | #5/#4 | #6/#5 |
| storage at 3 Weeks | — | — | — | — | — | — | — | — | #5/#4 | #6/#5 | #6/#5 | #6/#5 | #8/#6 |
| ambient temp. 4 Weeks | — | — | — | — | #4/#3 | #5/#4 | #6/#5 | #6/#5 | #6/#5 | #6/#5 | #6/#5 | #6/#5 | #8/#6 |
| 5 Weeks | — | — | — | — | — | — | — | — | #6/#5 | #5/#4 | #6/#5 | #6/#5 | #8/#6 |
| 5° C. after 1 Week | — | — | — | — | — | — | — | — | #6/#5 | #6/#5 | #6/#5 | #6/#5 | #8/#6 |
| storage at 2 Weeks | — | — | — | — | — | — | — | — | #6/#5 | #8/#6 | #8/#6 | #12/#8 | #8/#6 |
| 40° C. 3 Weeks | — | — | — | — | — | — | — | — | #8/#6 | #8/#6 | #8/#5 | —/8g | #12/#8 |
| 4 Weeks | — | — | — | — | — | — | — | — | #8/#6 | #12/#8 | #8/#6 | — | —/8g |
| 5 Weeks | — | — | — | — | — | — | — | — | 8g/#12 | —/8g | 8g/#12 | — | — |
| 50° C. 28mm | | | | | | | | | | | | | |
| 1 Week | #5/#4 | — | #8/#6 | #8/#6 | — | — | — | — | — | — | — | — | — |
| 2 Weeks | #6/#5 | — | #6/#5 | #8/#6 | — | — | — | — | — | — | — | — | — |
| 3 Weeks | #12/#8 | — | #8/#6 | #8/#6 | — | — | — | — | — | — | — | — | — |
| 4 Weeks | 8g/#12 | — | #8/#6 | #8/#6 | — | — | — | — | — | — | — | — | — |
| 8 Weeks | — | — | #8/#6 | #8/#6 | — | — | — | — | — | — | — | — | — |
| 5° C. after 32mm | | | | | | | | | | | | | |
| storage at 1 Month | — | — | — | — | #6/#5 | #5/#4 | #6/#5 | #6/#5 | — | — | — | — | — |
| 50° C. 2 Months | — | — | — | — | — | — | #8/#6 | #6/#5 | — | — | — | — | — |
| 5° C. after 82mm | | | | | | | | | | | | | |
| storage at 1 Month | — | — | — | — | — | #5/#4 | #6/#5 | #6/#5 | — | — | — | — | — |
| 20° C. 2 Months | — | — | — | — | — | — | #8/#6 | #6/#5 | — | — | — | — | — |

KEY

[a]Fertilizer grade comprising CN:$H_2O$:AN 74:15:6

[b]2-(8-heptadecenyl)-4,4-bis(hydroxymethyl)-2-oxazoline

[c]Mineral oil

[d]Paraffin:mineral oil 50:50

[e]Hollow glass spheres from 3-M Company

[f]Atomized aluminum

[g]Data in the form of "#4/#3" are minimum booster test results for the charge diameter specified, the detonation and storage temperatures indicated, and for the storage time, if any, indicated. The first number is the lowest blasting cap number that produced a detonation. The second number indicates that the charge failed with a blasting cap of that number. "8g" represents an 8 gram pentolite booster. The decimal number is detonation velocity in km/sec.

What is claimed is:

1. A cap-sensitive water-in-oil emulsion explosive composition consisting essentially of a water-immiscible liquid fuel as a continuous phase; an emulsified aqueous inorganic oxidizer salt solution as a discontinuous phase; an emulsifier selected from the group consisting of sorbitan fatty acid esters, glycol esters, unsaturated substituted oxazolines, and derivatives thereof; a density reducing agent; and as a part of the salt solution, calcium nitrate in an amount of from about 20% to less than 50% by weight based on the total composition to maintain cap-sensitivity of the composition under storage temperatures as high as 50° C.

2. An explosive composition according to claim 1 wherein the salt solution contains ammonium nitrate in an amount equal to or greater than the amount of calcium nitrate.

3. An explosive composition according to claim 1 wherein the liquid organic fuel is selected from the group consisting of mineral oil, waxes, benzene, toluene, xylene, and petroleum distillates such as gasoline, kerosene, and diesel fuels.

4. An explosive composition according to claim 3 wherein the liquid organic fuel is mineral oil.

5. An explosive composition according to claim 1 wherein the density reducing agent is selected from the group consisting of small, hollow, dispersed glass or plastic spheres, perlite, a chemical foaming or gassing agent, and a combination of each.

6. An explosive composition according to claim 5 wherein the density reducing agent is small, hollow, dispersed glass spheres.

7. An explosive composition according to claim 5 wherein the density reducing agent is perlite having an average particle size ranging from about 100 microns to about 150 microns in amount sufficient to reduce the density of the composition to within the range of about 0.9 to about 1.4 g/cc.

8. A cap-sensitive water-in-oil emulsion explosive composition consisting essentially of from about 1% to about 10% by weight based upon the total composition of a water-immiscible liquid organic fuel as a continuous phase; an emulsified aqueous inorganic oxidizer salt solution as a discontinuous phase, which salt solution comprises from about 20% to less than 50% calcium nitrate to maintain cap-sensitivity of the composition under storage temperatures as high as 50° C., from about 20% to about 60% ammonium nitrate and from about 2% to about 50% water; from about 0.2% to about 5% of emulsifier selected from the group consisting of sorbitan fatty acid esters, glycol esters, unsaturated substituted oxazolines, and derivatives thereof; and a density reducing agent in an amount sufficient to reduce the density of the composition to within the range from about 0.9 to 1.4 g/cc.

9. An explosive composition according to claim 8 wherein the oxidizer salt solution contains additionally a minor amount of an additional oxidizer salt.

* * * * *